US005201524A

United States Patent [19]

Csanady et al.

[11] Patent Number: 5,201,524

[45] Date of Patent: Apr. 13, 1993

[54] MARBLE BOARD GAME

[76] Inventors: Dezso Csanady; Christopher A. Csanady, both of 404 Wilmette Ave., Glenview, Ill. 60025

[21] Appl. No.: 837,148

[22] Filed: Feb. 19, 1992

[51] Int. Cl.[5] ..... A63F 3/00

[52] U.S. Cl. ..... 273/248; 273/280; 273/284; 273/287

[58] Field of Search ..... 273/280, 284, 287, 243, 273/248-254, 113, 116, 117

[56] References Cited

U.S. PATENT DOCUMENTS

| | | | |
|---|---|---|---|
| 2,460,264 | 1/1949 | Prentice et al. | 273/243 |
| 3,709,497 | 1/1973 | Barlow | 273/284 |
| 3,865,381 | 2/1975 | Hayes | 273/280 |
| 4,422,644 | 12/1983 | Holahan et al. | 273/280 |

FOREIGN PATENT DOCUMENTS

| | | | |
|---|---|---|---|
| 403761 | 1/1934 | United Kingdom | 273/249 |

*Primary Examiner*—Benjamin H. Layno
*Attorney, Agent, or Firm*—Jerome Goldberg

[57] ABSTRACT

A marble game including a stationary top board having a plurality of spaced apart game holes to define a game path. A rotatable bottom board includes a plurality of randomly spaced apart sink holes for aligning with the game holes. A marble positioned in a game hole aligned with a sink hole falls through and on to a ramp surface which guides the marble angularly downward to a retrieval location. A slot opening in the top board registers with a shift aperture in the bottom board. Applying an external force inside a registered shift aperture in a clockwise or counter clockwise direction rotates the bottom board until another shift aperture registers with the slot.

12 Claims, 2 Drawing Sheets

FIG. 1
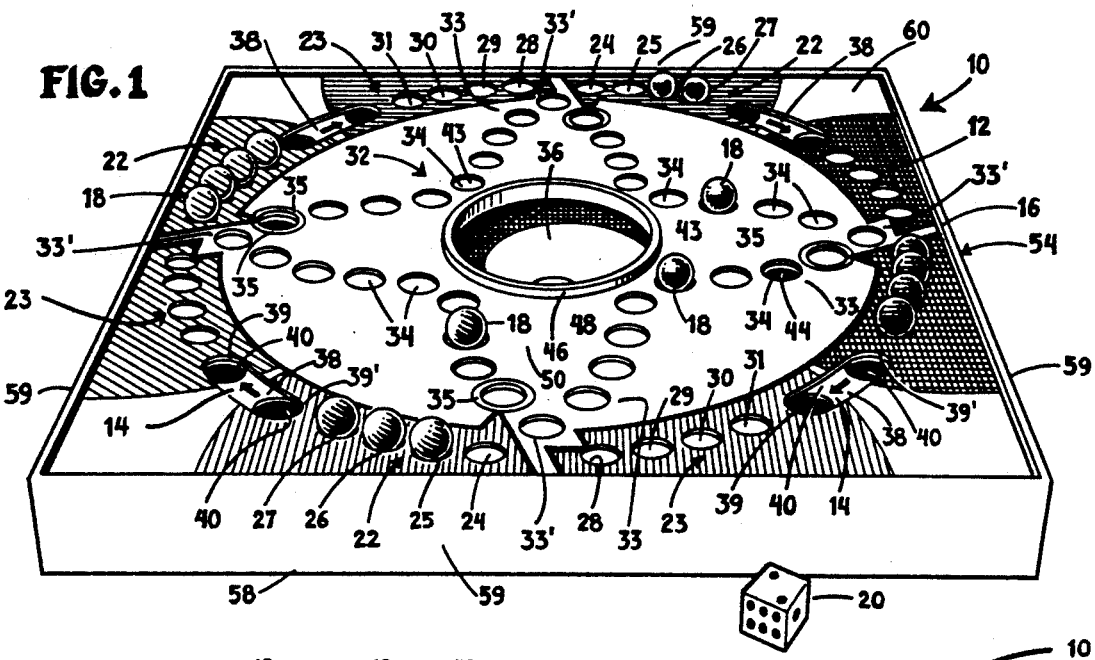
FIG. 2
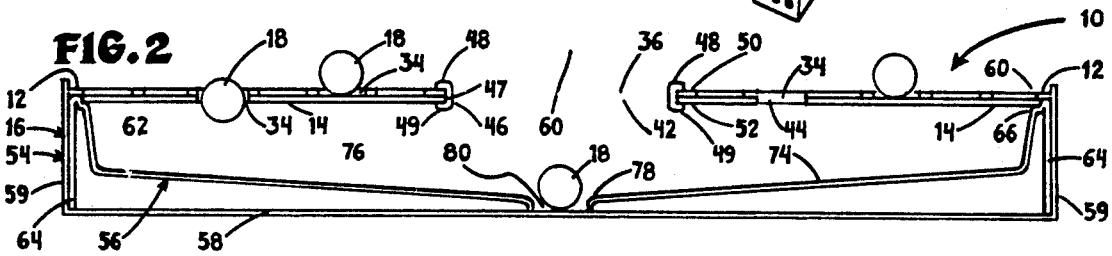
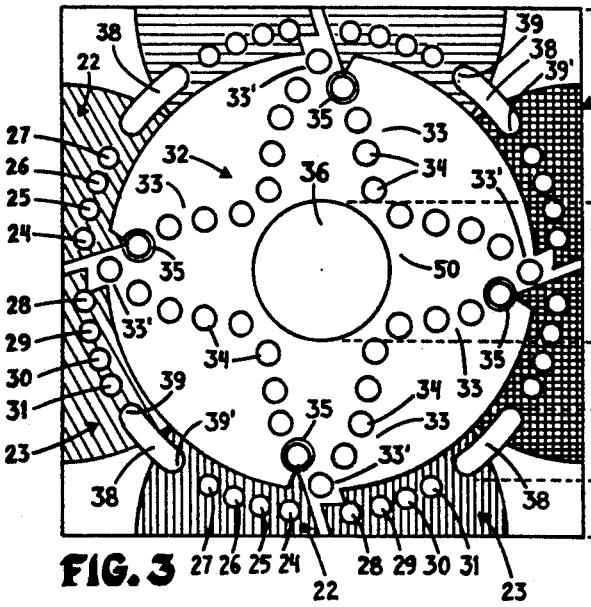
FIG. 3
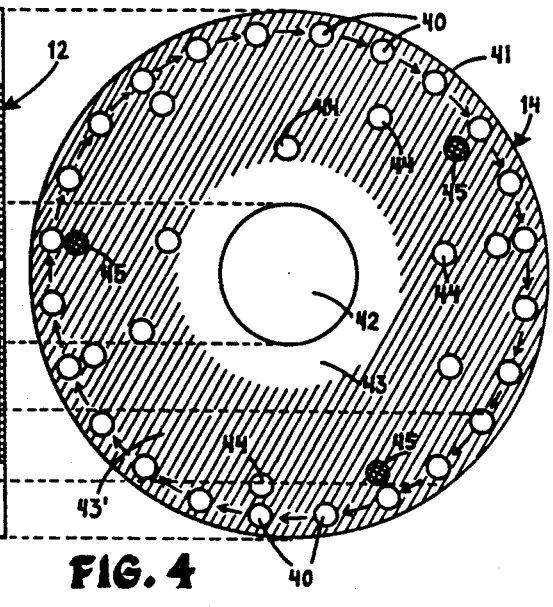
FIG. 4

MARBLE BOARD GAME

BACKGROUND OF THE INVENTION

1. Field of the Invention

This invention relates generally to games and more particularly relates to a board game having an article or marble which moves along a prescribed game path.

2. Description of the Prior Art

U.S. Pat. No. 3,762,714 (1973), WILSON, discloses a game including a stationary rectangular game board and a turntable positioned above the game board. A die is utilized for determining the rotation of the turntable. Four players may play the game and each player may move four marbles through a game path, from a start position until reaching a home position.

U.S. Pat. No. 2,419,000 (1947), ASHWORTH, provides a game having a plurality of rows of game openings for moving marbles from one opening to another when playing the game. Marble supporting tubes are disposed underneath the openings. These tubes may be revolved to position open areas underneath various game openings, and cause any marbles resting in such openings to drop through and be eliminated from further play during the game.

SUMMARY OF THE INVENTION

A game for two to four players comprising a stationary top board having a plurality of spaced apart game holes to define a game path for moving game articles or marbles from a start area to a finish area. A rotatable bottom board is positioned underneath the top board and includes a plurality of sink holes. A marble positioned in a game hole which is aligned with a sink hole falls through and is guided downward to an access location where the marble is retrieved for starting over the travel of the marble through the game path.

A plurality of shift apertures are formed in the bottom board. The top board includes a slot opening which registers with at least one shift aperture. Applying an external force inside said one shift aperture rotates the bottom board until another shift aperture registers with the slot.

A central bore is formed in the top board and the bottom board also includes a central bore. A ring extends inside said bores for securely gripping said top board and bottom board without preventing the revolving of the bottom board.

A base is provided for supporting the top and bottom boards. The base includes a ramp floor which angles inward and downward. A marble falling through an aligned game hole and sink hole is guided downward by the ramp floor to an access location. The ramp floor may have a substantially cone shape to guide the marble to an apex access area aligned with the bores of the top and bottom boards.

A primary object of the invention is to rotate a bottom board with respect to a stationary top board, in accordance with the manner for playing the game.

Another primary object is to align randomly positioned sink holes in the bottom board with game holes in the top board for sinking any marble positioned in an aligned game hole, to an easily accessible location for starting over the movement of the marble along the game path.

A primary feature of the invention is to provide a central top bore in the top board, a central bottom bore in the bottom board and a ramp surface for guiding the marble sinking through the aligned game hole and sink hole in an inward and downward direction to a central location in communication with said top and bottom bores.

Another primary feature is to provide a slot opening in the top stationary board to register with at least one shift aperture formed in a rotatable bottom board, so that the bottom board is revolved when an external force is applied inside the shift aperture until another shift aperture registers with the slot opening. A related feature is to revolve the bottom board until the shift aperture is moved in the clockwide or counter-clockwise direction, to adjacent one of the defining edges of the slot opening.

BRIEF DESCRIPTION OF THE DRAWING

Referring to the drawings, in which the same characters of references are employed to indicate corresponding similar parts throughout the several figures of the drawings.

FIG. 1 is a perspective view of the game, and embodying the principles of the invention;

FIG. 2 is an informational sectional view of the game in FIG. 1 and illustrates the marble dropping through an aligned game hole and sink hole and guided to a central access location;

FIG. 3 is a top view of the top board of the game;

FIG. 4 is a top view of the bottom board of the game;

DESCRIPTION OF THE PREFERRED EMBODIMENT

Figure 5:
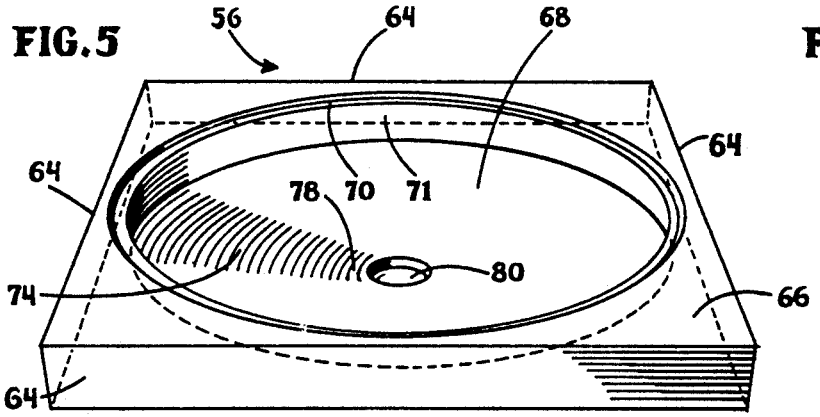
FIG. 5 is a perspective view of the support for the top and bottom boards and illustrating the substantially cone shaped floor of the support.

Referring now to FIGS. 1 thru 4 of the drawings, the reference numeral 10 indicates generally a marble game including a stationary top board 12 and a rotatable bottom board 14. The top board 12 and the bottom board 14 are supported on a square shaped base 16. When playing the game, marbles 18 are moved along the top board 12 in accordance with the numeral indication on a die 20. Two to four players would normally play the game 10 at one time.

The top board 12 includes four player start areas, each indicated generally by the reference numeral 22; and four player finish areas, each indicated generally by the reference numeral 23. Each player start area 22 includes four start holes 24, 25, 26 and 27 for seating four marbles; and each corresponding player finish area 23 includes finish holes 28, 29, 30 and 31 for seating the four marbles from the start area 22. Each start hole of the start area 22 and each finish hole of the finish area 23 has a diameter less than the diameter of the marbles 18.

The marbles 18 follow a game star cross path indicated generally by the reference numeral 32, as the marbles 18 move along the top board 12 from one of the player start areas 22 to the corresponding player finish area 23.

The star path 32 includes four leaves 33 and each having an outer tip 33'. The star path 32 is defined by a plurality of spaced apart game holes 34 having a diameter greater than the diameter of the marbles 18. The game hole 34 at the tip 33' of the star path 32 is the last game hole in the path 32. The first game hole is adjacent the last game hole and includes a circular border 35. Each start game hole has an arrow pointed to it, and the start hole for each player has a different colored circular border 35.

A circular top bore 36 is centrally positioned in the top board 12. Four spaced apart shift slot openings 38 are formed in the top board 12 outward from the star path 32 and adjacent to the corners of the base 16. Each slot 38 includes a forward edge 39 and a rear edge 39'. The slots 38 provide access to the bottom board 14 for rotating the bottom board. One of the shift slots 38 is easily accessible to each player.

The bottom board 14 includes a plurality of shift apertures 40 spaced apart around the entire bottom board, adjacent to the outer circular rim 41 of the bottom board 14. Two such shift apertures 40 align with each slot 38 in the top board 12. The shift apertures 40 are sufficiently sized so that the player could easily access the apertures 40 with a finger or pen, and rotate the bottom board 14 a distance corresponding to the space between apertures 40.

In the illustrative embodiment twenty four apertures 40 are equally spaced apart adjacent the outer rim 41 of the bottom board 14, or a distance of 15 degrees between apertures. Therefore, the bottom board 14 is moved fifteen (15) degrees if the bottom board is shifted a distance between adjacent shift apertures 40. Normally, when playing the game the bottom board 14 is rotated in the clockwise direction.

A bottom circular bore 42 is centrally positioned in the bottom board 14. The bottom bore 42 aligns with the top bore 36. A colored band 43 encircles the lower bore 42 on the outside surface 43' of the bottom board 14.

A plurality of sink holes 44 are randomly positioned in the bottom board 14 between the shift apertures 40 and the colored band 43. During the playing of the game 10, the sink holes 44 align with various game holes 34. A plurality of spaced apart color discs 45 are randomly positioned on the bottom board 14 to register with a game hole 34 at the tip 33' of the leaf 33 of the star path 32.

When any marble 18 is at a location in the path 32 where a sink hole 44 aligns with the game hole 34 containing the marble, the marble falls out of the game hole 34 and through the aligned sink hole 44 and is guided to the bottom of the base 16.

Figure 7:
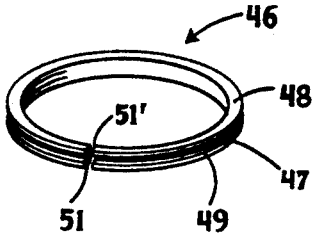
FIG. 7 is a perspective view of the split ring for attaching to the top and bottom board.

A flexible, circular split ring 46 (FIG. 7) secures the top board 12 and the bottom board 14 together. The ring 46 includes a circular groove 47 defined by an upper lip 48 and a lower lip 49.

The ring 46 is positioned inside the bottom bore 42 and the top bore 36 so that the upper lip 48 grips the outer surface 50 of the top board 12 encircling the top bore 36; and the lower lip 49 grips the inner surface 52 of the bottom board 14 encircling the bottom bore. The top and bottom boards 12 and 14 are sandwiched between the upper and lower lips 48,49 in a press fit association. The ring 46 prevents any appreciable vertical movement of the top and bottom boards 12 and 14, as the bottom board 14 is rotated.

The ring 46 is split to provide ends 51 and 51' adjacent to each other for accommodating the ring 46 to the size of the bores 36,42 of the top and bottom boards 12,14.

The base 16 comprises a substantially square box 54 (FIGS. 1 and 2) and a support 56 (FIGS. 5 and 6) positioned in the box 54. The box 54 includes a bottom wall 58, four side walls 59 and an open top end 60.

The support 56 has a square configuration and includes four sides flanges 64 and a top member 66. A circular opening 68 is formed in the top member 66 having a diameter slightly greater than the diameter of the bottom board 14.

Figure 6:
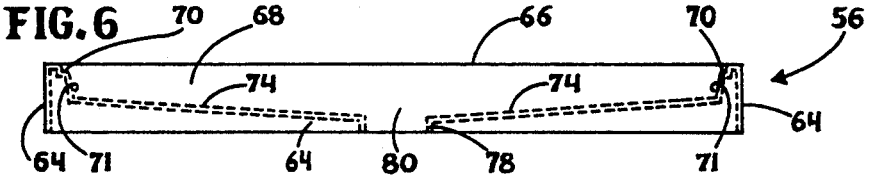
FIG. 6 is a side view of the support.

Turning now specifically to FIGS. 5 and 6, it will be seen that a circular ledge 70 is recessed in the opening 68 and formed to a circular internal side wall 71. The bottom board 14 is positioned inside the opening 68 and rests on the ledge 70 slightly spaced from the circular side edge 71, in substantial alignment with the top member 66.

The top board 12 is positioned on the bottom board 14 and on the top member 66 of the support 56, and the side edges of the top board 12 are adjacent the side walls 59 of the box 54.

The side wall 71 extends downward from the ledge 70 and inclines slightly inward to integrally connect to a substantially cone shaped floor 74. The floor 74 ramps downward and inward from the side wall 72 until reaching a central apex 78.

A hole 80 is formed in the apex 78 dimensioned to receive at least one marble 18. The hole 80 affords an entranceway to the bottom wall 58 of the box 54. The hole 80 is aligned with the upper bore 36 and the lower bore 42.

When the marble 18 passes from the top board 12 and through a sink hole 44 in the bottom board 14, it lands on the floor 74 and rolls inward and downward along the angled ramp of the floor 74 until reaching the central location at the apex 78 to stop inside the hole 80 and against the bottom wall 58 of the box 54.

The top and bottom bores 36 and 42 are sufficiently sized to enable the player to extend a hand or at least three finger through the top and bottom bores 42 for retrieving any marble 18 that has stopped in the hole 80 at the apex 78 of the floor 74. The retrieved marble is placed in one of the start holes 24, 25, ( 26 or 27 at the player's start position 22, to start over for travelling through the game path 32.

Playing the Game

The game 10 may be played by two to four players, and each player is given four marbles 18 having the same color but different from the colors of the other players. The first player who moves all of his or her marbles clockwise from the start area 22, completing the star path 34 and reaching the finish area 23, is the winner of the game.

Each player rolls the die 20 and the player rolling the highest number is the first to start the game. When the player rolls a 1 or 6, the player moves any one of the marbles seated in the start area 22 to the adjacent start game hole 34 having the colored circular border 35, and cannot advance along the game path 32 until the next turn.

The player on the next turn rolls the die and moves the marble in the start hole 34 clockwise along the game holes 34 corresponding to the number shown on the die. If the die reads a "6" the player moves one or more marbles a total of six spaces along the game path 32, and thereafter the shift aperture 40 registered with the shift slot 38 is moved to the forward or clockwise edge 39 of the shift slot 38 which moves the bottom board clockwise one space between shift apertures 40 (or 15 degrees).

A player may at any time forfeit his or her turn at rolling the die in favor of one shifting of the shift aperture registered with the shift slot.

A marble cannot land or stop on a game hole 34 already occupied by the marble of another player or a game hole 34 aligned with a sink hole 44. Under this condition, the player should try to move other marbles until the forward positioned marble has moved or the bottom board 14 has been shifted so that a sink hole 44 has moved to a different location and does not function to block the clockwise movement of the marble of the player. However, the player could move his marble past a game hole 34 already occupied or aligned with a sink hole 44. If no play is available the turn of the player is forfeited, but the player could elect to move the shift aperture 40 aligned with the shift slot 38.

When a sink hole 44 aligns with a game hole 34 having a marble 18 positioned therein, the marble will drop inside the game and will roll along a ramp floor 74 until reaching a centrally positioned apex 78. The marble at the apex is retrieved upon reaching through the bores 36 and 42 and the marble is returned to the start area 22, to start over the travel through the game path 32.

When a colored disc 45 positioned on the bottom board 14 aligns with a game hole 34 at the tip 33' of the star path 32 and the marble of the player reaches or has reached such aligned game hole, the player advances the marble clockwise to the next game hole 34 at the tip 33' of the path 32. If that game hole 34 is occupied or aligned with a sink hole 44, the player moves the marble to the nearest unoccupied game hole 34 behind such game hole 34 at the tip 33' of the star path 32.

The colored band 43 around the bottom bore 42 of the bottom board 14 affords a safety zone for the game holes 34 which are positioned above the colored band 43. Portions of the band 43 appear as colored spots aligning with game holes 34. In this safety zone there are no sink holes 44 to cause the marbles to drop out of the game path 32.

The player finishes the trip through the game path 32 upon his or her marble reaching the finish game hole 34 at the tip 33' of the star path 32 adjacent the finish area 23, but must reach such point at the exact count of the die 20. The winner of the game is the first player to bring all four marbles around the game path 32 to the player's finish area 23.

Various modifications of the invention of a marble board game described herein, are within the spirit and scope of the invention, the scope of which is limited solely and defined by the appended claims.

We claim:

1. A game comprising:

a top board having a game path, said game path including a plurality of spaced apart game holes;

a rotatable bottom board positioned underneath the top board, said bottom board including a plurality of spaced apart sink holes;

at least one game article for moving along said game path, said one game article being dimensioned to pass through said game holes and said sink holes;

a guide ramp for moving said game article angularly downward to one location, said game article falling on to said guide ramp after one of said sink holes is aligned with one of said game holes and the game article is positioned in said one game hole; and said top board including a centrally positioned top bore said bottom board including a centrally positioned bottom bore aligned with the top bore, said one location being centrally positioned underneath said bores, said game article positioned at said one location being retrievable through said bores.

2. The game of claim 1 includes:

a ring for press fitting inside the top bore of the top board and the bottom bore of the bottom board for securing the top board and bottom board together.

3. The game of claim 2, wherein said ring includes a circular groove defining an upper lip and a lower lip, said ring extending into said top and bottom bores, the areas of said bottom board and said top board encircling said top and bottom bores being press fitted between said lips.

4. The game of claim 3, wherein said ring is split to provide adjacent spaced apart ends for accommodating the ring to the size of said bores.

5. The game of claim 1, includes:

a slot opening formed in said top board having a forward edge and a rear edge; and a plurality of spaced apart shift apertures formed in said bottom board, at least one of said shift apertures being aligned with said slot, said shift apertures being sized to receive an object for applying an external force to move the bottom board toward one of the edges of the slot.

6. The game of claim 1, wherein said guide ramp is an inward and downward inclining wall, the lowest point of said guide wall being in alignment with said bores of the top and bottom boards.

7. The game of claim 1, wherein said top board is stationary and has a substantially rectangular shape and said bottom board has a substantially circular shape.

8. A game comprising:

a top board having a game path, said game path including a plurality of spaced apart game holes;

a rotatable bottom board positioned underneath the top board, said bottom board including a plurality of spaced apart sink holes;

at least one game article for moving along said game path, said one game article being dimensioned to pass through said holes and said sink holes;

a guide ramp extending downward and inward toward a central apex, said game article moving downward on said ramp until reaching said apex, said game article falling on said guide ramp after one of said sink holes is aligned with one of said game holes and the game article is positioned in said one game hole; and said top board including a centrally positioned top bore and said bottom board including a centrally positioned bottom bore aligned with the top bore, said apex being centrally positioned underneath said bores, said game article positioned at said apex being retrievable through said bores.

9. The game of claim 8, wherein said apex includes a hole, said game article moving on the surface of said guide ramp being directed into said apex hole.

10. The game of claim 9, further includes:

a box having a bottom, side walls and an open top;

a support including a top wall having a circular opening, side flanges and an inner circular wall having an upper end and a lower end, said top board being positioned over said opening, said support being positioned in the box; and a circular ledge recessed from the top wall opening and secured to the upper end of the inner wall, said bottom board being circular and having a diameter slightly less than the the diameter of the top wall opening, said bottom board reseting on said ledge, said guide ramp being a substantially cone shaped floor secured to the lower end of the inner wall and extending inward and downward therefrom to said apex, said bottom of the box being underneath said apex hole to retain the article in the apex hole.

11. The game of claim 9 wherein said article is a marble and said game includes:

a plurality of spaced apart colored discs formed on the bottom board to align with various game holes, to indicate further movement of the marble positioned in such game hole aligned with a disc;

a circular colored band centrally positioned on said bottom board, said sink holes being positioned outside of said band, portions of said band being viewed form the game holes to indicate being in a safety zone free from sink holes;

a slot opening formed in the top board, said slot having a forward edge and a rear edge; and a plurality of spaced apart shift apertures positioned ib the bottom board, one of said apertures being in registry with said slot, said bottom board being rotated when an external object is positioned in said one of said apertures in registry with said slot and an external force applied against the defining circular edge of the registered aperture for moving such aperture and thereby rotating said bottom board toward one of said edges of said slot.

12. The game of claim 11, wherein said shift apertures are equally spaced apart in a substantially circular pattern, so that one of said shift apertures is in registry with said slot, to enable the bottom board to be revolved 360 degrees.

* * * * *